US008265538B2

(12) United States Patent
Nishinoue et al.

(10) Patent No.: US 8,265,538 B2
(45) Date of Patent: Sep. 11, 2012

(54) FIXING DEVICE AND IMAGE FORMATION APPARATUS

(75) Inventors: Kazunori Nishinoue, Toyohashi (JP); Norikazu Okabe, Toyokawa (JP); Hideaki Hayashi, Toyokawa (JP); Taizou Oonishi, Hachioji (JP); Naoki Yamamoto, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 501 days.

(21) Appl. No.: 12/481,626

(22) Filed: Jun. 10, 2009

(65) Prior Publication Data

US 2009/0317154 A1 Dec. 24, 2009

(30) Foreign Application Priority Data

Jun. 18, 2008 (JP) ..... 2008-159067

(51) Int. Cl.
*G03G 15/20* (2006.01)

(52) U.S. Cl. ..... 399/329

(58) Field of Classification Search ..... 399/329, 399/328

See application file for complete search history.

(56) References Cited

U.S. PATENT DOCUMENTS 7,333,762 B2 * 2/2008 Oishi et al. ..... 399/329

FOREIGN PATENT DOCUMENTS

JP 2003-005553 A 1/2003

* cited by examiner

*Primary Examiner* — David Gray
*Assistant Examiner* — Erika J Villaluna
(74) *Attorney, Agent, or Firm* — Buchanan Ingersoll & Rooney PC

(57) ABSTRACT

Fixing belt is brought into pressure-contact with the surface of fixing roller such that fixing belt rotates according to rotation of fixing roller, thereby forming, between fixing belt and fixing roller, fixing nip portion through which recording sheets pass. A pressing area of an opposing surface of pressing member contacting the surface of fixing roller via fixing belt is smaller in each end portion of the opposing surface in the axis direction of fixing roller than in a central portion of the opposing surface in the axis direction of fixing roller. This makes speed of conveying recording sheets faster in each edge portion in the width direction perpendicular to a recording sheet conveyance direction than in a central portion in the width direction. Thus, creases of recording sheets can be prevented while a recording sheet passes through fixing nip portion between fixing roller and fixing belt mutually brought into pressure-contact.

11 Claims, 4 Drawing Sheets

<CENTRAL PORTION>

<END PORTION>

<CENTRAL PORTION>

<END PORTION>

FIXING DEVICE AND IMAGE FORMATION APPARATUS

BACKGROUND OF THE INVENTION

This application is based on application No. 2008-159067 filed on Jun. 18, 2008 in Japan, the content of which is hereby incorporated by reference.

(1) Field of the Invention

The present invention relates to a fixing device that fixes an unfixed image formed on the recording sheet such as a sheet of recording paper or an OHP sheet, and an image formation apparatus including the fixing device. The present invention particularly relates to technology that prevents creases of the recording sheet when the fixing device fixes the unfixed image with use of a fixing belt.

(2) Description of the Related Art

An image formation apparatus such as a photocopying machine is equipped with a fixing device that fixes an unfixed image formed on a recording sheet such as a sheet of recording paper or an OHP sheet. An example of such a fixing device is a belt-nip type fixing device. The belt-nip type fixing device includes a fixing roller that rotates with the surface thereof heated to a predetermined temperature, and an endless fixing belt. The belt-nip type fixing device has a structure in which the fixing roller and the fixing belt are mutually brought into pressure-contact with each other so as to form therebetween a fixing nip portion through which the recording sheet passes. The fixing belt that is brought into pressure-contact with the fixing roller rotates according to the rotation of the fixing roller. While the recording sheet on which the unfixed image has been formed passes through the fixing nip portion between the fixing roller and the fixing belt, the unfixed image formed on the recording sheet is heated and applied with pressure so as to be fixed on the recording sheet.

Japanese Laid-open patent application publication No. 2003-5553 discloses a structure in which a pressing member provided inside a closed rotation path of the fixing belt presses the rear surface of the fixing belt such that the surface of the fixing belt is brought into pressure-contact with the surface of the fixing roller. The pressing member is composed of a part having rigidity so as to press the fixing belt entirely in the width direction thereof with a predetermined pressure. The part having rigidity presses the fixing belt towards an axis (rotation center) of the fixing roller. This applies uniform pressure to the surface of the fixing roller along the rotating direction.

However, in the belt-nip type fixing device, speed at which the recording sheet is conveyed through the fixing nip portion between the fixing roller and the fixing belt possibly becomes uneven in the width direction of the fixing belt depending on the states of the fixing roller, the fixing belt and the pressing member, and the moisture state of the recording sheet, for example. This possibly causes creases of the recording sheet entering the fixing nip portion.

In the structure in which the pressing member presses the fixing belt, it is not easy to vary the speed of conveying the fixing belt in the width direction thereof. As a result, a problem arises that the creases of the recording sheet that passes through the fixing nip portion is not easily prevented.

Unlike the belt-nip type fixing device, in the fixing device in which the fixing roller is brought into pressure-contact with a pressure application roller, it is known that the creases of the recording sheet that passes through the fixing nip portion can be prevented by making a conveyance speed at which the recording sheet passes through the fixing nip portion faster in each edge portion of the fixing roller in the width direction thereof than in a central portion of the fixing roller in the width direction thereof. However, as disclosed in Japanese Laid-open patent application publication No. 2003-5553, in the belt-nip type fixing device in which the fixing belt pressed by the part having rigidity is brought into pressure-contact with the fixing roller to form the fixing nip, it is not easy to make the speed of conveying the recording sheet faster in each end portion of the fixing belt in the width direction thereof than in the central portion of the fixing belt in the width direction thereof. That is, in order to make the speed of conveying the recording sheet in the fixing nip portion faster in each end portion of the fixing belt in the width direction thereof than in the central portion of the fixing belt in the width direction thereof, it is necessary to deform the part having rigidity into a complicated shape, for example. Therefore, it takes a long time to manufacture such a part having rigidity, which is not economically efficient.

SUMMERY OF THE INVENTION

The present invention has an objective of providing a fixing device and an image formation apparatus that are capable of preventing creases of the recording sheet to fix a clear toner image onto a recording sheet, and are productively and economically efficient.

The objective of the present invention is achieved by a fixing device that fixes an unfixed image formed on a recording sheet comprising a fixing roller that is elastic and rotates with a surface thereof heated; a fixing belt that is brought into pressure-contact with a surface of the fixing roller; and a pressing member that presses an inner circumferential surface of the fixing belt to bring the fixing belt into pressure-contact with the surface of the fixing roller so as to allow the fixing belt to revolve according to the rotation of the fixing roller, and form a fixing nip portion between the fixing belt and the fixing roller, wherein the pressing member has an opposing surface opposing the inner circumferential surface of the fixing belt and including a pressing area that presses the surface of the fixing roller via the fixing belt, and part of the pressing area in each end portion of the opposing surface in an axis direction of the fixing roller is smaller than part of the pressing area in a central portion of the opposing surface in the axis direction.

In the fixing device having such a structure, a pressing area of the opposing surface that presses the surface of the fixing roller via the fixing belt is smaller in each end portion of the opposing surface in the axis direction of the fixing roller than in the central portion of the opposing surface in the axis direction of the fixing roller. Therefore, pressure intensity per unit pressing area of the fixing belt applied on the surface of the fixing roller is larger in each of the end portions of the opposing surface in the axis direction of the fixing roller than in the central portion of the opposing surface in the axis direction of the fixing roller. Thus, it is possible to make the speed of conveying the recording sheet that passes through the fixing nip portion faster in each of the end portions in a width direction of the recording sheet that is perpendicular to the recording sheet conveyance direction than in the central portion in the width direction of the recording sheet. As a result, a width direction tension towards a central portion of the recording sheet from each of edge portions of the recording sheet occurs in a portion (leading end portion) of the recording sheet, which is located downstream in the sheet conveyance direction and has passed through the fixing nip portion. On the other hand, an outward tension in each of the end portions occurs in a portion of the recording sheet immediately before entering the fixing nip portion. This can prevents creases of the recording sheet that passes through the fixing nip portion.

Preferably, an edge of the opposing surface located downstream in a recording sheet conveyance direction may project downstream in the recording sheet conveyance direction such that a central portion of the edge is located further downstream than each end portion of the edge, and the central portion of the opposing surface may press the surface of the fixing roller via the fixing belt such that the surface of the fixing roller makes contact with the fixing belt along a tangent line of the fixing roller.

Also, the edge of the opposing surface may be formed in a V shape such that a portion between each of the end portion of the edge and the central portion of the edge extends straight.

Also, the opposing surface may extend along the axis direction of the fixing roller, and press the surface of the fixing roller via the fixing belt such that the surface of the fixing roller makes contact with the fixing belt along a tangent line of the fixing roller.

Also, the pressing member may have a rigid body on which the opposing surface is formed.

Also, the pressing member may include an elastic member that brings the fixing belt into pressure-contact with the surface of the fixing roller at a position located upstream in the recording sheet conveyance direction from a position of the opposing surface.

BRIEF DESCRIPTION OF THE DRAWINGS

These and the other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

Figure 1:
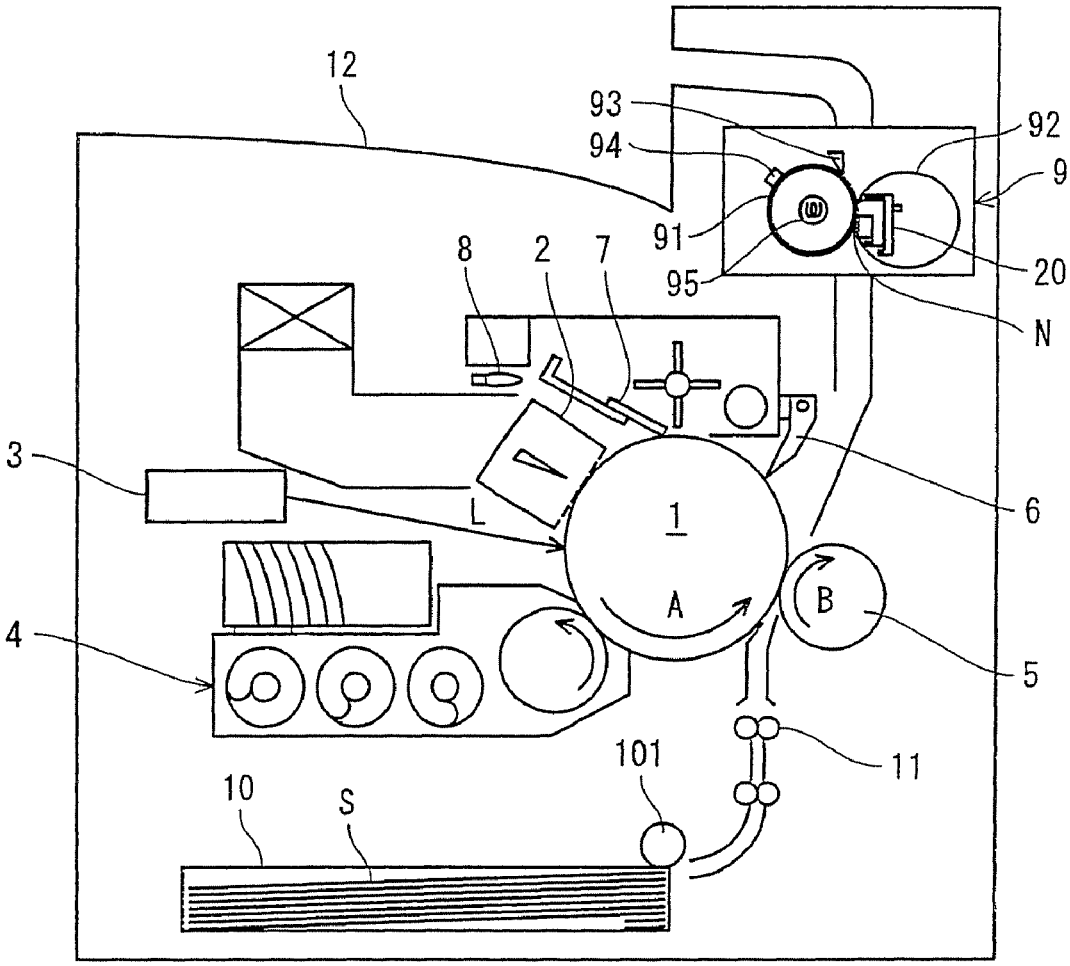
FIG. 1 schematically shows a structure of an image formation apparatus including a fixing device in an embodiment of the present invention.

FIG. 1 schematically shows a structure of an image formation apparatus including a fixing device in an embodiment of the present invention. The image formation apparatus forms a toner image of a predetermined color on a recording sheet such as a sheet of recording paper, or an OHP sheet.

The image formation apparatus shown in FIG. 1 includes a photosensitive drum 1 which is driven to rotate in a direction shown by an arrow A. Around the photosensitive drum 1 are arranged a charger 2, an exposure part 3, a developer 4 and a transfer roller 5 that are for forming a toner image on a recording sheet S using an electronic photographic method.

In the image formation apparatus, image data inputted from an external device is converted into a drive signal of a laser diode by a controller (not shown). The drive signal drives the laser diode provided in the exposure part 3. This causes the exposure part 3 to radiate a laser beam L according to image data. The charger 2 pre-charges the surface of the photosensitive drum 1 to a predetermined potential. The exposure part 3 emits a laser beam L to expose the surface of the photosensitive drum 1 to form a static latent image on the surface of the photosensitive drum 1. The developer 4 develops, with use of a toner, and makes the static latent image visible as a toner image.

Below the photosensitive drum 1, a recording sheet cassette 10 capable of housing a plurality of recording sheets S such as sheets of recording paper or OHP sheets. A sheet supply roller 101 supplies the recording sheets S housed in the recording sheet cassette 10 one sheet at a time. The recording sheets S supplied from the recording sheet cassette 10 are conveyed to the photosensitive drum 1 via a timing roller pair 11. The transfer roller 5 that rotates in a direction shown by an arrow B is arranged lateral to the photosensitive drum 1. The recording sheet S passes through a transfer nip portion at which the transfer roller 5 is brought into pressure-contact with the photosensitive drum 1. At that time, the toner image formed on the photosensitive drum 1 is transferred onto the recording sheet S by the effect of a transfer electrical field generated by a transfer voltage applied by the transfer roller 5.

The recording sheet S onto which the toner image has been transferred is detached from the photosensitive drum 1 by a detaching nail 6, and conveyed to the fixing device 9. The fixing device 9 includes a fixing roller 91, and a fixing belt 92 that is brought into pressure-contact with the fixing roller 91 by a pressing member 20. The fixing belt 92 that is brought into pressure-contact with the fixing roller 91 revolves according to the rotation of the fixing roller 91. A fixing nip portion N through which the recording sheet passes is formed between the fixing roller 91 and the fixing belt 92 that are brought into pressure-contact with each other.

A heater 95 heats the surface of the fixing roller 91 to a predetermined temperature that melts the toner. The heater 95 is provided into an axis center part of the fixing roller 91. The heater 95 is controlled based on the surface temperature of the fixing roller 91 measured by a thermistor 94. The unfixed toner image on the recording sheet S conveyed to the fixing device 9 passes through the fixing nip portion N which is a position at which the fixing roller 91 that rotates with the surface thereof being heated to the predetermined temperature is brought into pressure-contact with the fixing belt 92 that revolves according to the rotation of the fixing roller 91. This heats and applies pressure to the unfixed image on the recording sheet S, thereby fixing the unfixed image on the recording sheet S. The recording sheet S on which the toner image has been fixed is detached from the fixing roller 91 by a detaching nail 93, and ejected onto an eject tray 12.

Note that a cleaner 7 removes the toner remained on the surface of the photosensitive drum 1, and then an eraser 8 removes the remaining electrical charge of the photosensitive drum 1 on which the toner image has been transferred. The charger 2 charges the surface of the photosensitive drum 1 from which the remaining electrical charge has been removed according to the next image forming instruction. Subsequently, the toner image is formed on the recording sheet by the execution of the above-stated operations.

In such a way, the photosensitive drum 1, the charger 2, the exposure part 3, the developer 4, the transfer roller 5 and the recording sheet cassette 10 together constitute an unfixed image forming part that forms the unfixed image on the recording sheet S.

Figure 2:
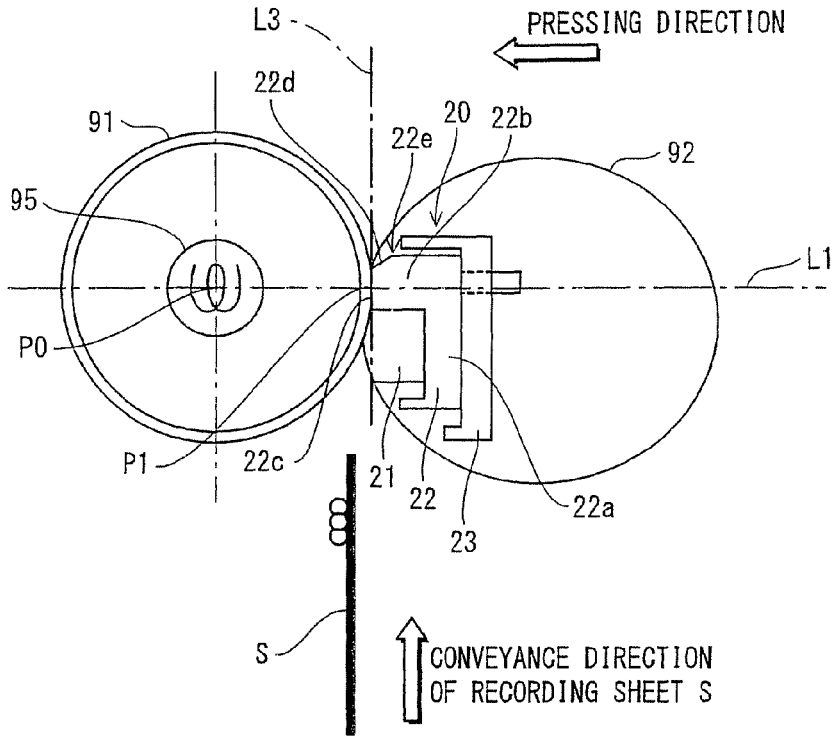
FIG. 2 schematically shows a cross-sectional view showing a structure of a central portion of a main part of the fixing device in the axis direction of the fixing roller provided in the fixing device.
Figure 3:
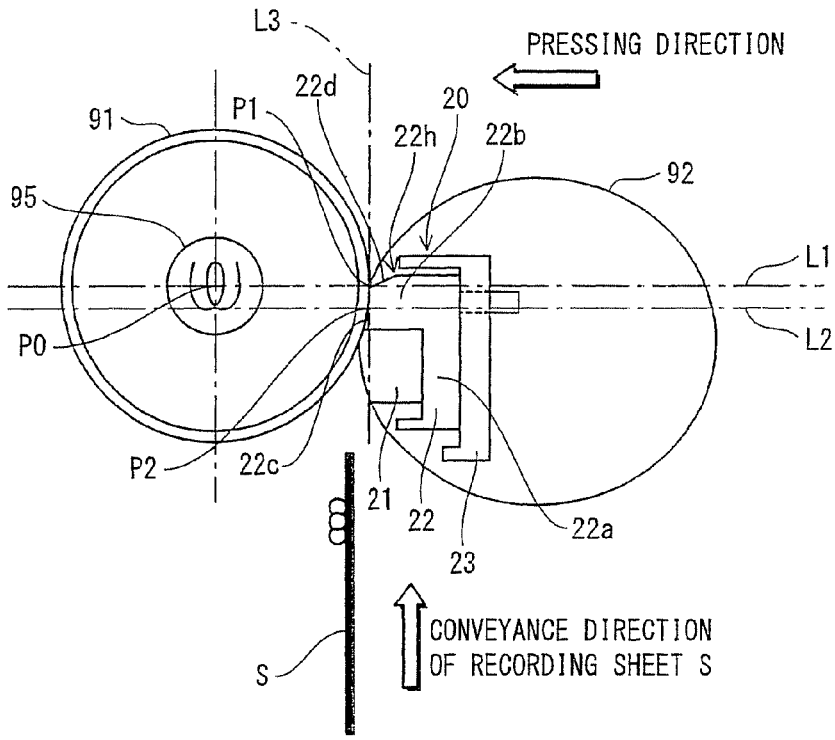
FIG. 3 schematically shows a cross-sectional view showing a structure of an end portion of the main part of the fixing device in the axis direction of the fixing roller provided in the fixing device.

Each of FIG. 2 and FIG. 3 schematically shows the cross-sectional view showing a structure of a main part of the fixing device 9. FIG. 2 schematically shows a cross-sectional view of a central portion of the main part in the axis direction of the fixing roller 91. FIG. 3 schematically shows a cross-sectional view showing an end portion of the main part in the axis direction of the fixing roller 91 provided in the fixing device.

The fixing roller 91 is composed of a metal such as aluminum or steel around 0.1 mm to 5.0 mm in thickness. The thickness of the fixing roller 91 is preferably between 0.2 mm to 1.5 mm when lightening of the weight and shortening of a warm-up time (time taken, after the heater is turned on, for the temperature of the fixing nip portion N to reach a temperature needed for fixing) taken into consideration. Although there is no particular limitation on a measurement of the outer diameter of the fixing roller 91, the outer diameter of the fixing roller 91 is preferably between 10 mm to 50 mm.

Also, a surface layer such as a fluorinated tube or a fluorinated coating such as PFA, PTFE or ETEE, a silicon tube, or silicon coating may be provided on the surface of the fixing roller 91 such that the surface of the fixing roller has a release property from the recording sheet S. The surface layer may have conductivity. The thickness of the surface layer is preferably around 5 μm to 100 μm. Also, an angle at which the surface layer makes contact with water should be 90 degrees or more, and is desirably 110 degrees or more. The surface roughness Ra is preferably around 0.01 μm to 50 μm. For example, "PFA350-J", "451HP-J" or "951HP Plus" manufactured by Dupont-Mitsui Fluorochemical Co., Ltd may be used for the surface layer.

In the case when the surface layer is provided on the surface of the fixing roller 91, an interlayer may be provided between the surface of the fixing roller 91 and the surface layer. A material having elasticity and high heat-resistance such as silicon rubber or fluoride rubber are desirable for the interlayer. Although the thickness of the interlayer may be arbitrary, the thickness of the interlayer is preferably around 0.05 mm to 2 mm.

The fixing belt 92 is an endless belt. The fixing belt 92 is brought into pressure-contact with the surface of the fixing roller 91 which is driven to rotate. Also, the fixing belt revolves according to the rotation of the fixing roller 91. The fixing belt 92 is composed of a belt-type material such as polyimide, polyphenylene sulfide, nickel, steel or SUS. Also, a surface layer such as the fluorinated tube or a fluorinated coating such as PFA, PTFE or ETEE, a silicon tube or a silicon coating may be provided, and the surface of the material may have the release property from the recording sheet S. Furthermore, the surface layer may have conductivity. The thickness of the surface layer is preferably around 50 μm to 100 μm. Although there is no limitation on the thickness of the fixing belt 92 as a whole, the thickness of the fixing belt 92 as a whole is preferably around 0.05 mm to 2 mm.

Each of edges of the fixing belt 92 in the width direction thereof is guided by a belt guide member (not shown). This causes the fixing belt 92 to revolve within a predetermined diameter. It is preferable that the fixing belt 92 revolves in around a 20 mm to 100 mm diameter.

The pressing member 20 is provided inside the revolving path of the fixing belt 92 that faces the fixing roller 91. The pressing member 20 brings the surface (outer circumference surface) of the fixing belt 92 into pressure-contact with the surface (outer circumference surface) of the fixing roller 91. The pressing member 20 includes a rigid member 22 and an elastic member 21. The rigid member 22 presses the rear surface (inner circumferential surface) of the fixing belt 92 entirely in the width direction thereof such that the outer circumference surface of the fixing belt 92 is brought into pressure-contact with the surface of the fixing roller 91 entirely in the width direction of the fixing belt 92 (direction parallel to the axis direction of the fixing roller 91). The elastic member 21 presses, entirely in the width direction of the fixing belt 92, a portion of the rear surface of the fixing belt 92 at a position located further upstream in a direction of conveying the recording sheet S than a portion of the rear surface of the fixing belt 92 pressed by the rigid member 22.

A holding frame 23 extending along the axis direction of the fixing roller 91 entirely holds the rigid member 22. The elastic member 21 is mounted on the surface of the rigid member 22 that faces the fixing roller 91 in the downstream side of a direction of conveying the recording sheet S. The holding frame 23 is composed of a metal drawn material, a metal extruded material, a sheet metal or the like such as aluminum or steel. Also, each end portion of the holding frame 23 in the longitudinal direction thereof is capable of moving towards and away from the fixing roller 91. The holding frame 23 is supported while being biased so as to be close to the fixing roller 91 at all times by a biasing member such as a spring. In such a way, substantially uniform pressure is applied to the rigid member 22 and the elastic member 21 along the width direction of the fixing belt 92.

The elastic member 21 is composed of a single elastic body so as to have a constant rectangular cross section. The elastic member 21 is elastically brought into pressure-contact with the unfixed toner image formed on the recording sheet S. The elastic body composing the elastic member 21 is preferably a material having high heat resistance such as a silicon rubber or fluorinated rubber. The elastic member 21 should be projected closer to the fixing roller 91 compared to a top portion of a pressing part 22*b* of the rigid member 22 on the side of fixing roller 91. Although the length of the projection is not particularly limited, the elastic member 21 is preferably projected around 0.1 mm to 10 mm. Also, although there is no particular limitation on the rigidity of the elastic member 21, the rigidity is preferably around 15 degrees to 30 degrees on Asker C scale. Furthermore, the elastic member 21 does not have to be composed of the above-stated single elastic body. A metal plate such as SUS, aluminum or steel may be integrally provided with the elastic body with an imposition property, workability and the like taken into consideration.

Figure 4B:
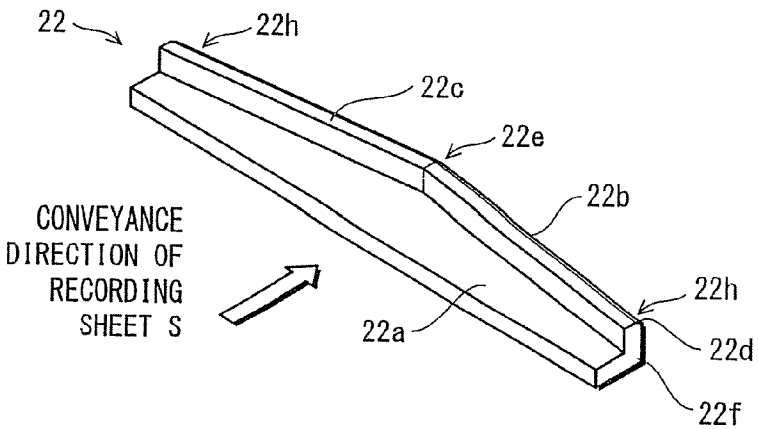
FIG. 4B is a perspective top view of a side portion of the fixing roller of the rigid member facing up.
Figure 4A:
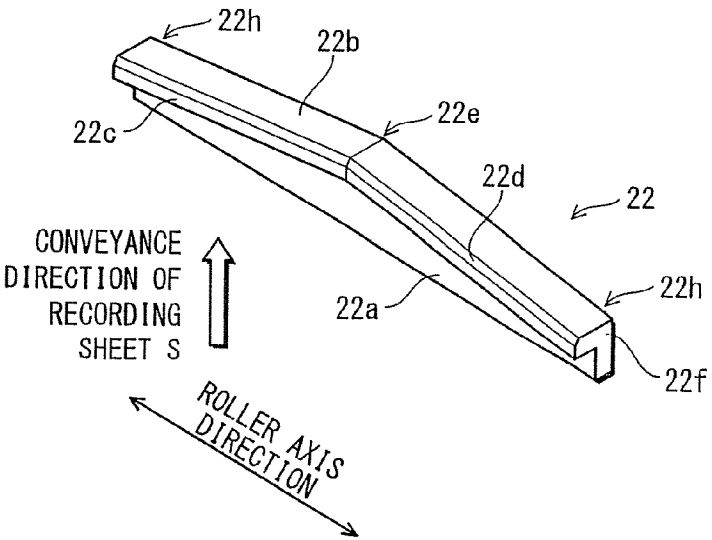
FIG. 4A is a perspective view of a rigid member composing the pressing member provided in the fixing device when viewed from above the fixing roller.

Each of FIG. 4A and FIG. 4B is a perspective view of the rigid member 22. FIG. 4A is a perspective view of the rigid member 22 when viewed from above the fixing roller 91. FIG. 4B is a perspective top view of a portion of the rigid member 22 on the side of the fixing roller 91. As shown in FIG. 4A and FIG. 4B, the rigid member 22 is L-shaped when viewed perceptively. The rigid member 22 includes a main body 22*a* and the pressing part 22*b*. The main body 22*a* is in a plate shape stretching along the axis direction of the fixing roller 91. The width direction of the main body 22*a* is along the conveyance direction of the recording sheet S (hereinafter, such a direction is referred to as "sheet conveyance direction"). The pressing part 22*b* is provided so as to project from an edge portion 22*f* located downstream in the sheet conveyance direction in the main body 22*a* to the fixing roller 91. The main body 22*a* and the pressing part 22*b* are integrally formed in the above-stated predetermined shapes by a single rigid body having predetermined rigidity that allows each end portion of the main body 22*a* and the pressing part 22*b* in the longitudinal direction thereof to deflect towards and away from the fixing roller 91.

Resin such as polyphenylene sulfide, polyimide or liquid crystal polymer, a metal such as aluminum or steel, or ceramic, for example, are preferable for the rigid body composing the rigid member 22. Note that the structure of the rigid member 22 is not limited to the above-stated structure, and may be any structure as long as the pressing part 22*b* that presses the fixing belt 92 is a rigid body.

The plate-shaped main body 22*a* has a longitudinal length that allows the main body 22*a* to oppose the fixing roller 91 in the axis direction thereof. A central portion 22*e* in the longitudinal direction of the rigid member 22 opposes the central portion of the fixing roller 91 in the axis direction thereof. The pressing part 22*b* is provided at an edge portion 22*f* of the main body 22*a*. A portion of the pressing part 22*b* located downstream in the sheet conveyance direction projects, in a V shape, downstream in the sheet conveyance direction such that a portion between each end portion 22*h* of the pressing part 22*b* in the longitudinal direction thereof and the central portion 22*e* of the pressing part 22*b* in the longitudinal direction thereof extends straight.

A top portion of the pressing part 22*b* on the fixing roller side, as shown in FIG. 2 to FIG. 4A and FIG. 4B, has the opposing surface 22*c* which is flat along the direction of conveying the recording sheet S. Also, the top portion has an inclined surface 22*d* which is adjacent to a portion located downstream in the sheet conveyance direction from the opposing surface 22*c*.

As with the pressing part 22*b*, the opposing surface 22*c* has a V shape that projects downstream in the sheet conveyance direction such that a portion between each of the end portions 22*h* of the opposing surface 22*c* in the longitudinal direction thereof and the central portion 22*e* of the opposing surface 22*c* in the longitudinal direction thereof extends straight. An edge of the opposing surface 22*c* located downstream in the sheet conveyance direction is formed such that a portion between each end of the edge and a center of the edge extends straight.

The inclined surface 22*d* that is adjacent to the opposing surface 22*c* is inclined away from the fixing roller 91 as the inclined surface 22*d* becomes close to the downstream side of the conveyance direction.

Since the opposing surface 22*c* as a whole is uniformly flat along the direction of conveying the recording sheet S, a rear side (inner circumferential surface) of the fixing belt 92 is pressed in the axis direction of the fixing roller 91 with substantially uniform pressure. This brings the fixing belt 92 into pressure-contact with the fixing roller 91.

As shown in FIG. 2, a central position P1 of the central portion 22*e* of the opposing surface 22*c* in the sheet conveyance direction is positioned on an extended line L1 of a radius of the fixing roller 91 that passes through an axis position of the fixing roller 91 (rotation center, shown as P0 in FIG. 2). The opposing surface 22*c* as a whole is flat along a tangent line L3 of the fixing roller 91 which is perpendicular to such an extended line L1.

Each of the end portions 22*h* of the opposing surface 22*c* in the longitudinal direction thereof is located upstream in the sheet conveyance direction from the central portion 22*e* of the opposing surface 22*c* in the longitudinal direction thereof. Also, the opposing surface 22*c* as a whole is formed so as to be flat along the tangent line L3. Therefore, in each of the end portions 22*h* in the longitudinal direction of the opposing surface 22*c*, the central position P2 in the sheet conveyance direction is, as shown in FIG. 3, positioned on a straight line L2 which is positioned upstream in the sheet conveyance direction with respect to the extended line L1 and is parallel to the extended line L1 with a predetermined interval therebetween.

The rigid member 22 having such a shape is brought into pressure-contact with the fixing roller 91 via the fixing belt 92. This deforms the shape of the contact portion on the surface of the fixing roller 91 into a concave shape.

The rigid member 22 is pressed in the axis direction of the fixing roller 91 towards the axis of the fixing roller 91 with substantially uniform pressure. However, a deformation volume of the portion on the surface of the fixing roller 91 that deforms into a concave shape is larger in each end portion 22*h* of the opposing surface 22*c* in the longitudinal direction of the fixing roller 91 (the axis direction of the fixing roller 91) than in the central portion 22*e* of the opposing surface 22*c* in the longitudinal direction of the fixing roller 91. The reasons are described in the following.

Figure 5A:
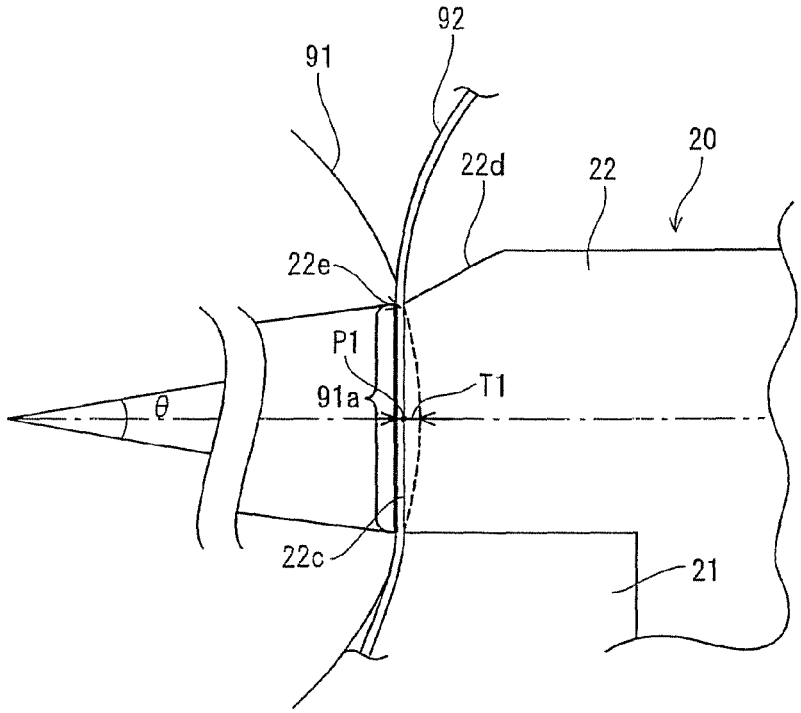
FIG. 5A is an enlarged cross-sectional view showing the relationship with the fixing belt in the central portion in the axis direction of the fixing roller provided in the fixing device.
Figure 5B:
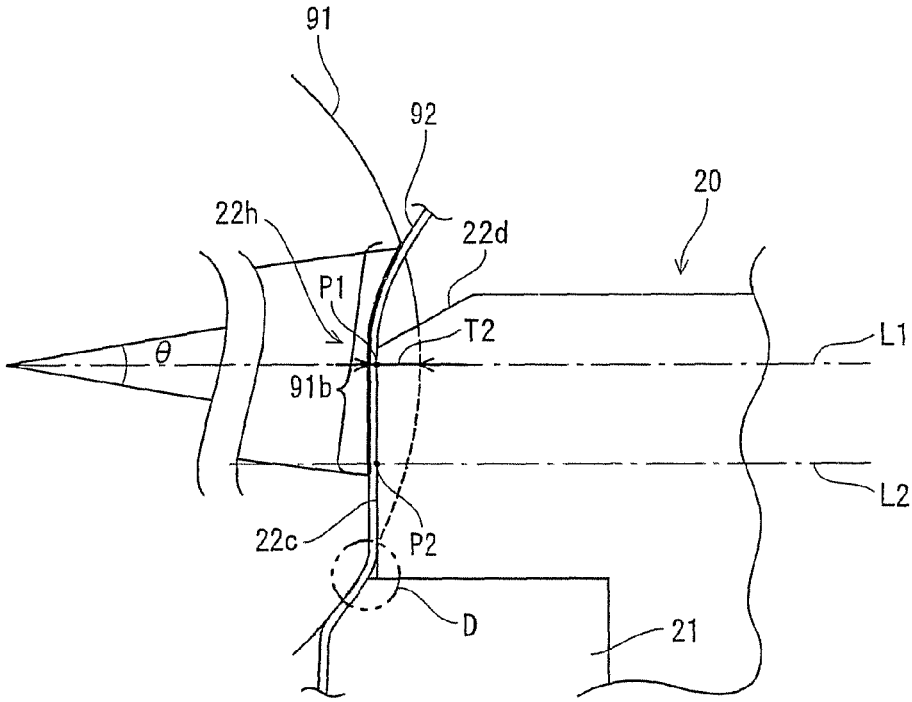
FIG. 5B is an enlarged cross-sectional view showing the relationship with the fixing belt in each end portion in the axis direction of the fixing roller.

1. When the central portion 22*e* of the opposing surface 22*c* in the longitudinal direction thereof is pressed by the fixing roller 91 via the fixing belt 92, the fixing roller 91 changes, as shown in FIG. 5A, from a non-pressed state (shown by a broken line in FIG. 5A) to a pressed state. That is, the fixing roller 91 falls into a state where portions of the fixing roller 91 on the surface thereof that correspond to both of the side portions of the opposing surface 22*c* deform into concave shapes. A central position P1 is a center of the side portions of the opposing surface 22*c* in the sheet conveyance direction in the central portion 22*e* of the opposing surface 22*c* in the longitudinal direction thereof.
2. In each of the end portions 22*h* of the opposing surface 22*c* in the longitudinal direction thereof, on the other hand, the central position P2 in the sheet conveyance direction is located upstream in the conveyance direction from the extended line L1 of the radius of the fixing roller 91, as shown in FIG. 5B. Therefore, a portion D of the opposing surface 22*c*, which is located upstream in the sheet conveyance direction is not in contact with the surface of the fixing roller 91.
3. In such a way, a pressing area that presses the fixing roller 91 via the fixing belt 92 is smaller in each of the end portions 22*h* of the opposing surface 22*c* in the longitudinal direction thereof than in the central portion 22*e* of the opposing surface 22*c* in the longitudinal direction thereof. Accordingly, the pressure intensity per unit pressing area that acts on the surface of the fixing roller 91 by the opposing surface 22*c* becomes larger in each of the end portions 22*h* of the opposing surface 22*c* than in the central portion 22*e* of the opposing surface 22*c*.

When the pressure intensity per unit pressing area that acts on the surface of the fixing roller 91 by the opposing surface 22*c* in each of the end portions 22*h* thereof increases compared to the pressure intensity per unit pressing area that acts on the surface of the fixing roller 91 by the opposing surface 22*c* in the central portion 22*e* thereof, the circumferential length that the recording sheet S makes contact with the surface of the fixing roller 91 becomes longer in each of the end portions 22*h* in the axis direction of the fixing roller 91 than in the central portion 22*e*. The reasons are described in the following.

That is, since the rigid member 22 has a rigidity that allows each of the end portions in the longitudinal direction of the rigid member 22 to deflect towards and away from the fixing roller 91, each of the end portions 22*h* of the opposing surface 22*c* deflects when the pressure intensity per unit surface area that acts on the surface of the fixing roller 91 by the opposing surface 22*c* becomes larger in each of the end portions 22*h* of the opposing surface 22*c* in the axis direction of the fixing roller 91 than in the central portions 22*e* of the opposing surface 22*c* in the axis direction of the fixing roller 91. This allows a depth T2 (see FIG. 5B) of a portion of the surface of the fixing roller 91 deformed into a concave shape in each of the end portions 22*h* of the opposing surface 22*c* to be larger than a depth T1 (see FIG. 5A) of a portion of the surface of the fixing roller 91 deformed into a concave shape in the central portion 22*e* of the opposing surface 22*c*. In this case, if the recording sheet S makes contact, in the central portion 22*e* of the opposing surface 22*c*, with the surface of the fixing roller 91 by a circumferential length 91*a* corresponding to a central angle θ of the fixing roller 91, each of the end portions 22*h* in the axis direction of the fixing roller 91 is displaced more downstream in the sheet conveyance direction compared to the central portion 22*e*. Therefore, since the recording sheet S is recessed more deeply in each of the end portions 22*h*, a circumference length 91*b* that the recording sheet S makes contact with the surface portion of the fixing roller 91 is longer than the circumference length 91*a* when the circumference lengths 91*a* and 91*b* correspond to the same angle θ.

In such a way, the speed of conveying the recording sheet S becomes faster in each of the end portions 22*h* in the axis direction of the fixing roller 91 than in the central portion 22*e* in the axis direction of the fixing roller 91. That is, since the fixing roller 91 rotates at constant angular speed, per unit time length (distance) that the recording sheet S is conveyed along the inner circumferential surface of the portion of the surface of the fixing roller 91 deformed into a concave shape becomes longer in each of the end portions 22*h* of the rigid member 22 in the longitudinal direction thereof than in the central portion 22*e* of the rigid member 22 in the longitudinal direction thereof.

When the recording sheet S passes through the fixing nip portion N in such a state, a width direction tension from each of edge portions of the recording sheet S towards a central portion of the recording sheet S occurs in a portion (leading end portion) of the recording sheet S, which is positioned downstream in the sheet conveyance direction and has passed through the fixing nip portion N. This makes the central portion of the recording sheet S in the width direction to be deflected, which generates tension in a portion of the recording sheet S, which is positioned upstream in the sheet conveyance direction and has not entered the fixing nip portion N. As a result, it is possible to prevent creases of the recording sheet S when the recording sheet S passes through the fixing nip portion N. This allows the clear toner image to be fixed on the recording sheet S.

Generally, it is possible to prevent the creases of the recording sheet S by making the speed of conveying the recording sheet faster in each of the end portions of the recording sheet S in the width direction thereof than in the central portion of the recording sheet S in the width direction thereof.

A ratio of a maximum pressure (peak pressure) applied by the opposing surface 22*c* to the central portion of the fixing roller 91 in the axis direction thereof to the a maximum pressure applied by the opposing surface 22*c* to each of the end portions of the fixing roller 91 in the axis direction thereof should be larger than 1 and equal to or smaller than 2, and is preferably in the range of 1.1 to 1.7.

As described in the above, in the belt-nip method that forms the fixing nip portion N between the fixing roller 91 and the elastic fixing belt 92 by pressing the fixing belt 92 with use of the rigid member 22, each end portion of the flat opposing surface 22*c* of the pressing part 22*b* of the rigid member 22 in the axis direction of the fixing roller 91 is positioned more upstream in the sheet conveyance direction than a central portion of the opposing surface 22*c* in the axis direction of the fixing roller 91. With such a simple structure, the conveyance speed of the recording sheet S can be faster in each of the end portions 22*h* of the rigid member 22 in the axis direction of the fixing roller 91 than in the central portion 22*e* of the rigid member 22 in the axis direction of the fixing roller 91. As a result, it is not necessary to deform the shape of the rigid member 22 that presses the fixing belt 92 into a complicated shape. This markedly improves economic efficiency and productivity. Also, the position of the rigid member 22 may be determined such that the central position of the pressing member 22 in the longitudinal direction thereof is positioned on the extended line of the radius of the fixing roller 91. This means that it is possible to assemble the fixing device easily.

Note that although the edge of the opposing surface 22*c* of the pressing part 22*b* of the rigid member 22 located downstream in the sheet conveyance direction projects downstream in the sheet conveyance direction such that a portion between each of the end portions of the edge in the longitudinal direction thereof and the center of the edge in the longitudinal direction thereof extends straight, thereby making the speed of conveying the recording sheet S at edge portions of the recording sheet S in the width direction thereof faster than the speed of conveying the recording sheet in the central portion of the recording sheet S in the width direction thereof, the structure of the rigid member 22 is not limited to this. However, the pressure intensity per unit pressing area applied by the opposing surface 22*c* to the surface of the fixing roller 91 may be made larger in each of the end portions of the surface of the fixing roller 91 in the longitudinal direction thereof than in the central portion of the surface of the fixing roller 91 in the longitudinal direction thereof by the following steps, for example. The opposing surface 22*c* of the pressing part 22*b* of the rigid member 22 is formed so as to extend along the width direction of the fixing belt 92. The pressing area of each end portion of the flat opposing surface 22*c* in the longitudinal direction thereof is formed so as to be smaller than the pressing area of the central portion of the opposing surface 22*c* in the longitudinal direction thereof. In this case, the pressing area of the opposing surface 22*c* may be continuously or discontinuously reduced from each of the end portions of the opposing surface 22*c* towards the central portion of the opposing surface 22*c*.

Furthermore, although the edge portion of the opposing surface 22*c* located downstream in the sheet conveyance direction projects downstream in the sheet conveyance direction such that a portion between each of the end portions of the opposing surface 22*c* in the longitudinal direction thereof and the central portion of the opposing surface 22*c* in the longitudinal direction thereof extends straight, a projection amount of the edge may gradually vary. In this case, it is preferable that the projection amount of the edge that gradually varies is as small as possible so as to prevent a tension that acts in the width direction of the recording sheet S from remarkably varying.

The present invention is widely applicable in the technical field of the image formation apparatus such as a photocopying machine provided with the belt-nip type fixing device. Since the present invention can prevent creases of recording sheets without losing the productivity and economic efficiency, the industrial utility value of the present invention is extremely high.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A fixing device that fixes an unfixed image formed on a recording sheet, the fixing device comprising:

a fixing roller that is elastic and rotates with a surface thereof heated;

a fixing belt that is brought into pressure-contact with the surface of the fixing roller; and a pressing member that presses an inner circumferential surface of the fixing belt to bring the fixing belt into pressure-contact with the surface of the fixing roller so as to allow the fixing belt to revolve according to the rotation of the fixing roller, and form a fixing nip portion between the fixing belt and the fixing roller, wherein the pressing member has an opposing surface opposing the inner circumferential surface of the fixing belt and including a pressing area that presses the surface of the fixing roller via the fixing belt, part of the pressing area in each end portion of the opposing surface in an axis direction of the fixing roller is smaller than part of the pressing area in a central portion of the opposing surface in the axis direction, and a pressure intensity per unit area that acts on a surface of the fixing roller by each end portion is greater than a pressure intensity per unit area that acts on a surface of the fixing roller by the central portion.

2. The fixing device of claim 1, wherein an edge of the opposing surface located downstream in a recording sheet conveyance direction projects downstream in the recording sheet conveyance direction such that a central portion of the edge is located further downstream than each end portion of the edge, and the central portion of the opposing surface presses the surface of the fixing roller via the fixing belt such that the surface of the fixing roller makes contact with the fixing belt along a tangent line of the fixing roller.

3. The fixing device of claim 2, wherein the edge of the opposing surface is formed in a V shape such that a portion between each of the end portion of the edge and the central portion of the edge extends straight.

4. The fixing device of claim 1, wherein the opposing surface extends along the axis direction of the fixing roller, and presses the surface of the fixing roller via the fixing belt such that the surface of the fixing roller makes contact with the fixing belt along a tangent line of the fixing roller.

5. The fixing device of claim 1, wherein the pressing member has a rigid body on which the opposing surface is formed.

6. The fixing device of claim 1, wherein the pressing member includes an elastic member that brings the fixing belt into pressure-contact with the surface of the fixing roller at a position located upstream in the recording sheet conveyance direction from a position of the opposing surface.

7. An image formation apparatus comprising:

an image formation part operable to form an unfixed image on a recording sheet, and the fixing device of claim 1 to which the recording sheet on which the unfixed image has been formed in the image formation part is supplied.

8. A fixing device that fixes an unfixed image formed on a recording sheet, the fixing device comprising:

a fixing roller that is elastic and rotates with a surface thereof heated;

a fixing belt that is brought into pressure-contact with the surface of the fixing roller; and a pressing member that presses an inner circumferential surface of the fixing belt to bring the fixing belt into pressure-contact with the surface of the fixing roller so as to allow the fixing belt to revolve according to the rotation of the fixing roller, and form a fixing nip portion between the fixing belt and the fixing roller, wherein the pressing member has an opposing surface opposing the inner circumferential surface of the fixing belt and including a pressing area that presses the surface of the fixing roller via the fixing belt, part of the pressing area in each end portion of the opposing surface in an axis direction of the fixing roller is smaller than part of the pressing area in a central portion of the opposing surface in the axis direction, an edge of the opposing surface located downstream in a recording sheet conveyance direction projects downstream in the recording sheet conveyance direction such that a central portion of the edge is located further downstream than each end portion of the edge, the central portion of the opposing surface presses the surface of the fixing roller via the fixing belt such that the surface of the fixing roller makes contact with the fixing belt along a tangent line of the fixing roller, and the edge of the opposing surface is formed in a V shape such that a portion between each of the end portion of the edge and the central portion of the edge extends straight.

9. The fixing device of claim 8, wherein the pressing member has a rigid body on which the opposing surface is formed.

10. The fixing device of claim 8, wherein the pressing member includes an elastic member that brings the fixing belt into pressure-contact with the surface of the fixing roller at a position located upstream in the recording sheet conveyance direction from a position of the opposing surface.

11. An image formation apparatus comprising:

an image formation part operable to form an unfixed image on a recording sheet, and the fixing device of claim 8 to which the recording sheet on which the unfixed image has been formed in the image formation part is supplied.

* * * * *